US010519879B2

(12) United States Patent
Shiraishi

(10) Patent No.: US 10,519,879 B2
(45) Date of Patent: Dec. 31, 2019

(54) DETERMINING IN-CYLINDER PRESSURE BY ANALYZING CURRENT OF A SPARK PLUG

(71) Applicant: NISSAN MOTOR CO., LTD., Yokohama-shi, Kanagawa (JP)

(72) Inventor: Taisuke Shiraishi, Kanagawa (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 140 days.

(21) Appl. No.: 15/116,667

(22) PCT Filed: Feb. 17, 2014

(86) PCT No.: PCT/JP2014/053601
§ 371 (c)(1),
(2) Date: Aug. 4, 2016

(87) PCT Pub. No.: WO2015/122004
PCT Pub. Date: Aug. 20, 2015

(65) Prior Publication Data

US 2016/0348596 A1 Dec. 1, 2016

(51) Int. Cl.
*F02P 17/12* (2006.01)
*F02D 35/02* (2006.01)
(Continued)

(52) U.S. Cl.
CPC ..... *F02D 35/024* (2013.01); *F02P 3/0407* (2013.01); *F02P 17/12* (2013.01); *F02D 41/22* (2013.01)

(58) Field of Classification Search
CPC .... F02D 35/024; F02D 41/22; F02D 41/1498; F02P 3/0407; F02P 17/12; F02P 5/153; G01M 15/08
(Continued)

(56) References Cited

U.S. PATENT DOCUMENTS 4,836,015 A * 6/1989 Krage ..... G01L 23/08 702/140
5,408,870 A * 4/1995 Noble ..... F02P 3/02 73/114.13
(Continued)

FOREIGN PATENT DOCUMENTS

EP 0652364 A2 5/1995
JP H01-106958 A 4/1989
(Continued)

OTHER PUBLICATIONS

Alfio Dario Grasso Er Al: "Esitmation of In-Cylinder Pressure Using Spark Plug Discharge Current Measurements", Sep. 8-12, 2013, 2013 European Conference on Circuit Theory and Design, pp. 57-60.*
(Continued)

*Primary Examiner* — Hai H Huynh
*Assistant Examiner* — Gonzalo Laguarda
(74) *Attorney, Agent, or Firm* — Drinker Biddle & Reath LLP

(57) ABSTRACT

In determining an in-cylinder pressure by analyzing a secondary current detected by a secondary current detection resistor, an engine controller is configured to detect an engine revolution speed and a discharge duration during which the secondary current flows. The discharge duration is correlated with a gas pressure between electrodes of a spark plug at ignition timing, that is, an in-cylinder pressure, and is different depending on the engine revolution speed. The engine controller is further configured to estimate the in-cylinder pressure at ignition timing based on the engine revolution speed and the discharge duration. An amount of time-dependent change in mechanical compression ratio, caused by accumulation of deposits, is detected based on the estimated in-cylinder pressure at ignition timing.

23 Claims, 7 Drawing Sheets

(51) Int. Cl.
*F02P 3/04* (2006.01)
*F02D 41/22* (2006.01)

(58) Field of Classification Search
USPC ..... 123/406.41, 406.23, 406.22; 701/111, 701/110; 73/114.04, 114.16, 114.22
See application file for complete search history.

(56) References Cited

U.S. PATENT DOCUMENTS

| | | | | |
|---|---|---|---|---|
| 2005/0126544 | A1* | 6/2005 | Ott | F02D 41/009 123/491 |
| 2006/0086177 | A1* | 4/2006 | Okubo | G01L 23/225 73/35.12 |
| 2015/0101319 | A1* | 4/2015 | Takada | F01N 3/2066 60/301 |

FOREIGN PATENT DOCUMENTS

| | | | |
|---|---|---|---|
| JP | S57-194043 | U | 12/1992 |
| JP | H07-198545 | A | 8/1995 |
| JP | 2705041 | B2 | 1/1998 |
| JP | H10-196507 | A | 7/1998 |
| JP | 2001-020805 | A | 1/2001 |
| JP | 2005-048621 | A | 2/2005 |
| JP | 2012-117503 | A | 6/2012 |
| WO | WO 03/060307 | A1 | 7/2003 |

OTHER PUBLICATIONS

Alfio Dario Grasso et al., "Estimation of in-cylinder pressure using spark plug discharge current measurements", 2013 European Conference on Circuit Theory and Design (ECCTD 2013): Dresden, Germany, Sep. 8-12, 2013, Jan. 1, 2013, pp. 57-60, XP0553d1692, DOI: 10.1109/ECCTD.2013.6662274, ISBN: 978-1-4799-2857-6.

* cited by examiner

FIG. 4A
FIG. 4B
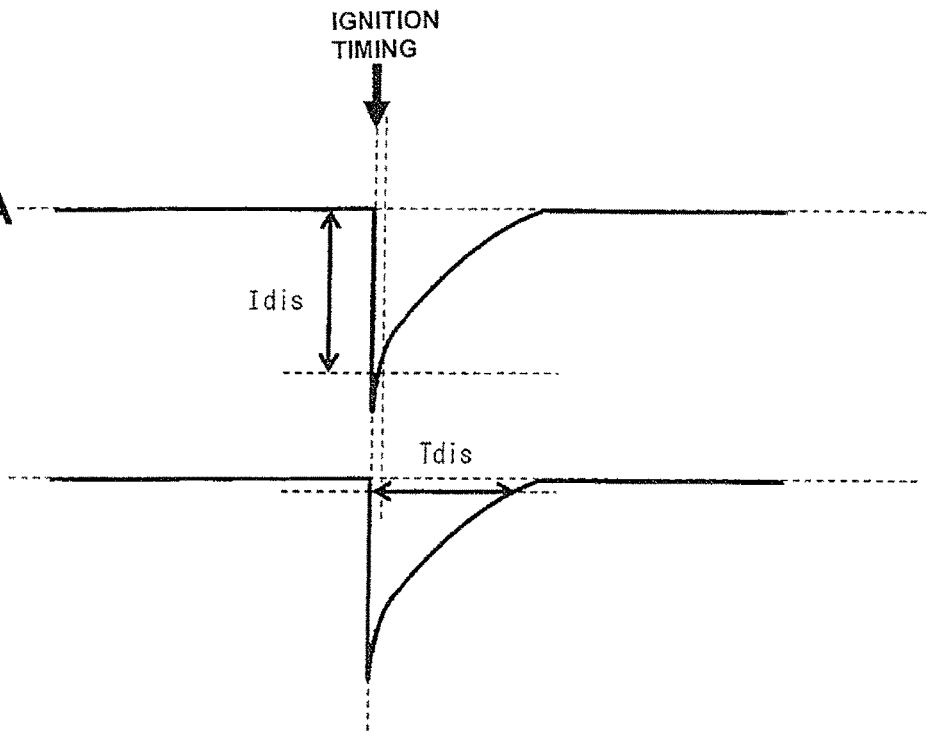
FIG. 5
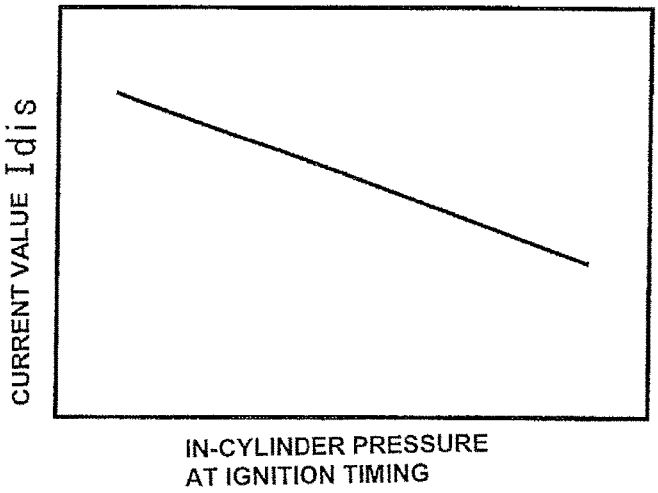

DETERMINING IN-CYLINDER PRESSURE BY ANALYZING CURRENT OF A SPARK PLUG

TECHNICAL FIELD

The present invention relates to the improvement of an ignition device and ignition method for an internal combustion engine in which a discharge voltage is generated between electrodes of a spark plug connected to a secondary coil by energizing a primary current to a primary coil of an ignition coil and interrupting the primary current.

BACKGROUND ART

On ignition devices using an ignition coil, a high discharge voltage is produced or induced in a secondary coil by interrupting a primary current at given ignition timing after having energized the primary current to a primary coil, thus generating an electric discharge between the opposing electrodes of a spark plug with a dielectric breakdown in the air-fuel mixture. In more detail, an excessively high-voltage capacitive discharge is momentarily generated. Subsequently to the capacitive discharge, an induced discharge is generated. During the induced discharge, the secondary current flowing across the electrodes decreases comparatively rapidly into a triangular waveform with the lapse of time from the start of the discharge.

Patent document 1 discloses a technology in which the current value of the secondary current flowing across the electrodes of a spark plug is detected, and it is determined that a misfire occurs when the detected current value of the secondary current becomes a prescribed value or less before expiration of a predetermined time from a generation of an ignition command signal.

However, the Patent document 1 never discloses a correlation between the secondary current and the compression ratio.

On the other hand, Patent document 2 discloses a technology in which cranking operation is performed without fuel injection immediately after a start of an internal combustion engine, and a compression ratio is estimated for each individual cylinder, using a temperature of intake air introduced into each of the cylinders and a as temperature in each of exhaust ports into which exhaust gases are exhausted from the individual cylinders. In the Patent document 2, for instance, a fuel injection amount for each individual cylinder is corrected, using a variation (a dispersion) in compression ratio of each individual cylinder.

However, with the aforementioned prior-art system configuration, a temperature sensor has to be arranged for each individual cylinder. This leads to the more complicated configuration.

CITATION LIST

Patent Literature

Patent document 1: Japanese Patent No. JP2705041

Patent document 2; Japanese Patent Provisional Publication No. JP2012-117503

SUMMARY OF INVENTION

It is, therefore, in view of the previously-described drawbacks of the prior art, an object of the invention to detect an in-cylinder pressure at ignition timing, eventually, an actual compression ratio at ignition timing, with a simple configuration that utilizes an ignition device.

In the present invention, in an ignition device for an internal combustion engine in which a discharge voltage is generated between electrodes of a spark plug connected to a secondary coil by energizing a primary current to a primary coil of an ignition coil and interrupting the primary current, the ignition device is equipped with a secondary current detection means for monitoring a secondary current flowing across the electrodes, and an in-cylinder pressure estimation means for estimating an in-cylinder pressure at ignition timing based on the secondary current.

Also in the present invention, in an ignition method for an internal combustion engine in which a discharge voltage is generated between electrodes of a spark plug connected to a secondary coil by energizing a primary current to a primary coil of an ignition coil and interrupting the primary current, the ignition method comprises monitoring a secondary current flowing across the electrodes, and estimating an in-cylinder pressure at ignition timing based on the secondary current.

According to another aspect of the invention, it is preferable that the in-cylinder pressure at ignition timing is estimated based on a current value of the secondary current immediately after completion of capacitive discharge.

That is, according to a new knowledge of the inventor, the magnitude of a current value of the secondary current is correlated with a gas pressure (that is, an in-cylinder pressure) near the electrodes at which a discharge is generated. The higher the gas pressure, the smaller the current value. In particular, there is a fixed correlation between a current value of the secondary current and a gas pressure, irrespective of a change in engine revolution speed, a change in the intensity of gas flow, and the like. Therefore, it is possible to univocally estimate the in-cylinder pressure at ignition timing based on the current value of the secondary current immediately after completion of capacitive discharge. By the way, a peak value of the current tends to largely fluctuate during the capacitive discharge, and thus it is difficult to exactly measure the peak value. Hence, in the present invention, the current value immediately after completion of capacitive discharge is used.

Also, according to another aspect of the invention, it is preferable that the in-cylinder pressure at ignition timing is estimated based on an engine revolution speed and a discharge duration during which the secondary current flows.

That is, according to a new knowledge of the inventor, in a similar manner to the current value of the secondary current, a discharge duration during which the secondary current flows is also correlated with a gas pressure (that is, an in-cylinder pressure) near the electrodes. The higher the gas pressure, the shorter the discharge duration. Additionally, the discharge duration is different depending on the engine revolution speed. The higher the engine revolution speed, the shorter the discharge duration. Therefore, it is possible to estimate the in-cylinder pressure at ignition timing based on the discharge duration and the engine revolution speed.

In this manner, according to the invention, it is possible to determine an in-cylinder pressure at ignition timing only by monitoring the secondary current flowing across the electrodes during operation of the internal combustion engine. For instance, a change in compression ratio over time, and a dispersion in compression ratio between cylinders, and the like can be detected.

BRIEF DESCRIPTION OF DRAWINGS

FIG. 3 is a waveform diagram illustrating a primary current of an ignition coil and the like.

FIG. 4 is an explanatory view illustrating objects to be detected, in which FIG. 4A shows the current value of a secondary current, whereas FIG. 4B shows the discharge duration during which the secondary current flows.

FIG. 5 is a characteristic diagram illustrating the relationship between the current value and the in-cylinder pressure at ignition timing.

DESCRIPTION OF EMBODIMENTS

One embodiment of the present invention is hereinafter described in detail with reference to the drawings.

Figure 1:
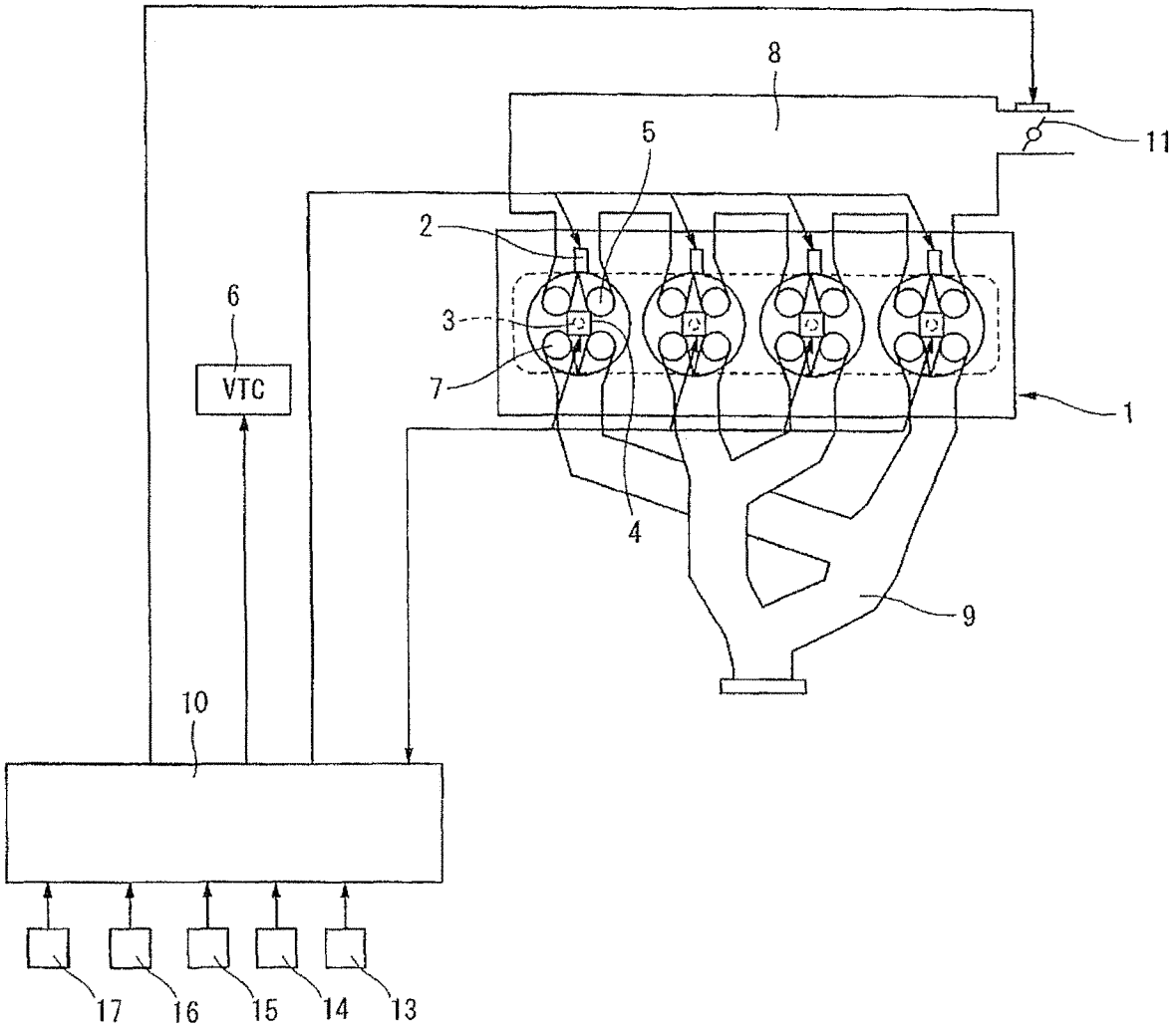
FIG. 1 is an explanatory view illustrating the system configuration of one embodiment of an internal combustion engine to which the invention is applied.

FIG. 1 shows the system configuration of an automotive internal combustion engine 1 to which the invention is applied. The internal combustion engine 1 is an in-line four-cylinder in-cylinder direct injection spark-ignited internal combustion engine. Each individual cylinder is provided with a fuel injection valve 2 for injecting fuel into the cylinder. Each individual cylinder is also provided with a spark plug 3 installed in the center of the wall surface of a roof of a combustion chamber for igniting a generated air-fuel mixture. Spark plug 3 is connected to an ignition unit 4 (described later) installed for each individual cylinder. For instance, each of ignition units 4 is arranged such that ignition unit 4 is connected directly to a terminal of the top end of spark plug 3.

Additionally, each cylinder is equipped with intake valves 5 and exhaust valves 7. The top ends of intake ports, which are connected to an intake collector 8, are opened and closed by means of respective intake valves 5, whereas the top ends of exhaust ports, which are connected to an exhaust passage 9, are opened and closed by means of respective exhaust valves 7. Hereupon, in the shown embodiment, also provided on the side of intake valves 5 is a variable valve actuation device 6 capable of variably controlling valve open timing and valve closure timing (at least valve closure timing) of each of intake valves 5. By the way, as a variable valve actuation device 6 used in the embodiment, for example, a valve actuation system, which is configured to simultaneously vary valve timings of intake valves 5 of all of cylinders, may be used. Instead of using the previously-discussed valve actuation system, more preferably, another type of valve actuation system, which is configured to individually vary valve timings of intake valves 5 for each individual cylinder, may be used.

An electronically-controlled throttle valve 11, whose opening is controlled responsively to a control signal from an engine controller 10, is installed in the inlet of intake collector 8.

Signals, detected by various sensors, namely, a crankangle sensor 13, an airflow meter 14, a water temperature sensor 15, an accelerator opening sensor 16, and an air-fuel ratio sensor 17 and the like, are inputted to the engine controller 10. The crankangle sensor is provided for detecting engine revolution speed. The airflow meter is provided for detecting an intake-air quantity. The water temperature sensor is provided for detecting a coolant temperature. The accelerator opening sensor is provided for detecting a depression amount of an accelerator pedal depressed by the driver. The air-fuel ratio sensor is provided for detecting an exhaust air-fuel ratio. Engine controller 10 controls, based on these detected signals, a fuel injection amount and fuel injection timing attained via fuel injection valve 2, ignition timing of the spark plug 3 through the use of ignition unit 4, valve open timing and valve closure timing of each individual intake valve 5, and valve opening of throttle valve 11, and the like.

Figure 2:
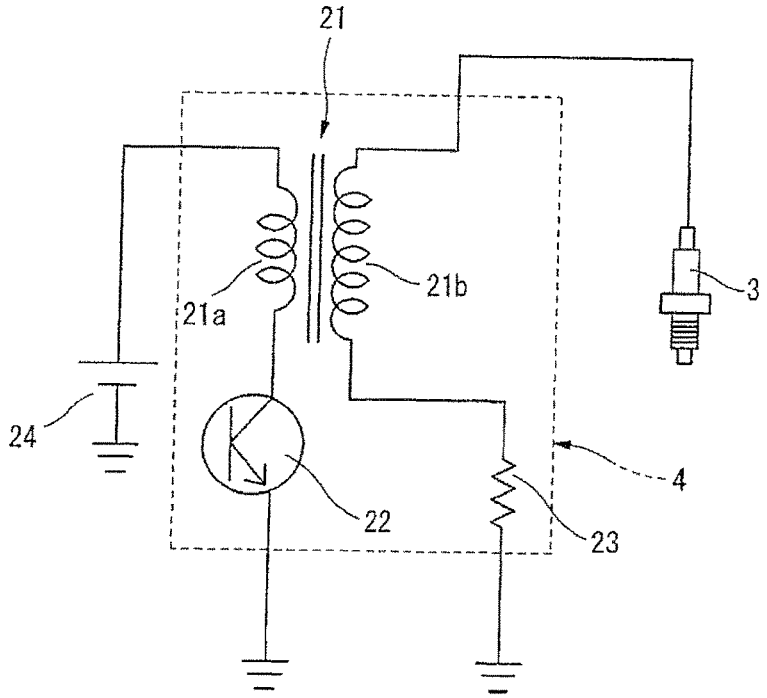
FIG. 2 is an explanatory view illustrating the configuration of an ignition unit of each cylinder.

Referring to FIG. 2, there is shown the detailed configuration of ignition unit 4. The ignition unit is comprised of an ignition coil 21 including a primary coil 21*a* and a secondary coil 21*b*, and an igniter 22 for controlling energization of a primary current to the primary coil 21*a* and interruption of the primary current. An on-vehicle battery 24 is connected to the primary coil 21*a* of ignition coil 21, while spark plug 3 is connected to the secondary coil 21*b*. A secondary current detection resistor 23 is installed in series with the secondary coil 21*b* for monitoring a secondary current flowing across the electrodes of spark plug 3 during discharge. A signal representing the secondary current for each individual cylinder, detected by means of the secondary current detection resistor 23, is inputted into the engine controller 10, and then the input informational signal is monitored by the engine controller 10.

Figure 3:
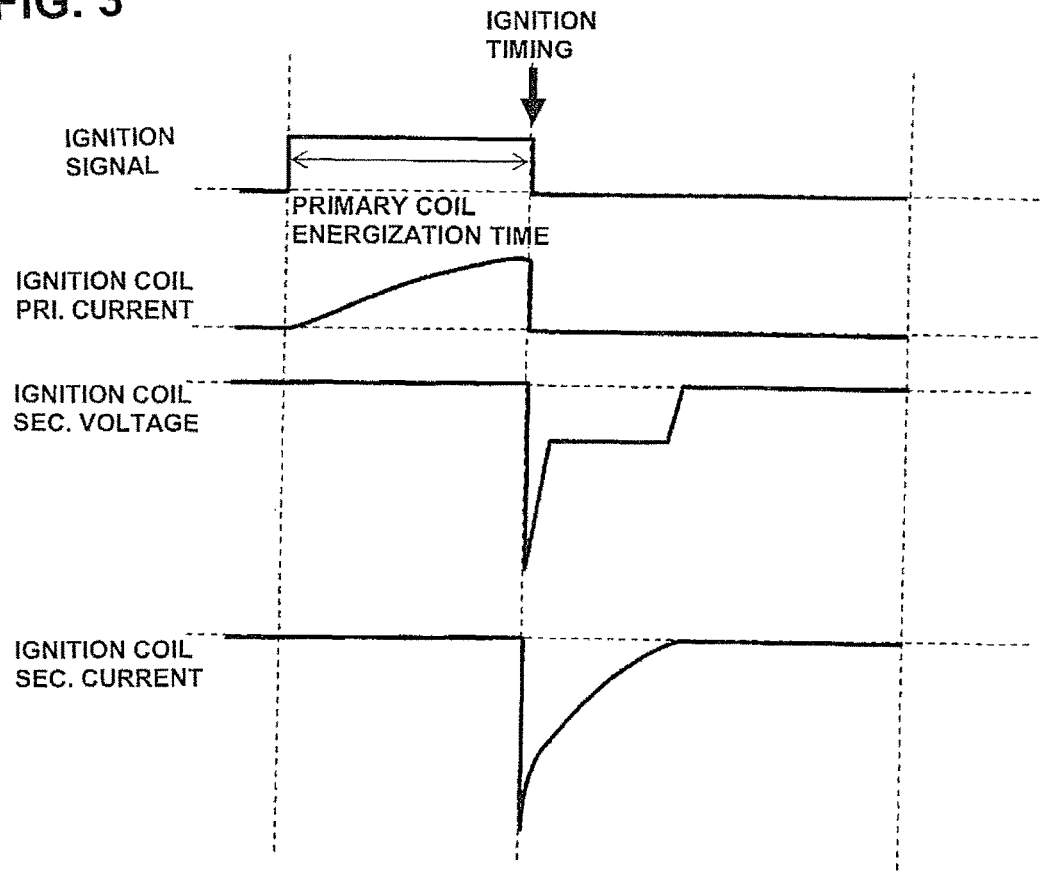

Referring to FIG. 3, there is shown the operation of ignition unit 4 which uses the ignition coil 21 configured as discussed above. Responsively to a control signal (an ignition signal) outputted from engine controller 10, a primary current is energized through the igniter 22 to the primary coil 21*a* of ignition coil 21 for an appropriate energization time. The primary current is interrupted at given ignition timing. Owing to such interruption of the primary current, a high discharge voltage (a secondary voltage) is produced or induced in the secondary coil 21*b*, thus generating an electric discharge between the electrodes of spark plug 3 with a dielectric breakdown in the air-fuel mixture. In more detail, an excessively high-voltage capacitive discharge is momentarily generated. Subsequently to the capacitive discharge, an induced discharge is generated. During the induced discharge, the secondary current flowing across the electrodes decreases comparatively rapidly into a triangular waveform with the lapse of time from the start of the discharge.

In the first embodiment of the invention, in-cylinder pressure estimation is performed based on a substantial peak value of the secondary current. That is, as shown in FIG. 4A, a current value Idis of the secondary current immediately after completion of capacitive discharge is read as a substantial peak value. For instance, a current value Idis at the time when a predetermined time (a very short time) has expired from the ignition timing is detected. This is because the current value during capacitive discharge having a very high voltage in a very short time tends to be comparatively unstable, and thus it is difficult to accurately detect the current value during the capacitive discharge.

According to a new knowledge of the inventor, the detected current value (the substantial peak value) of the secondary current, which is explained by reference to FIG. 4A, is correlated with an in-cylinder pressure at ignition timing (i.e., a gas pressure between the electrodes). As shown in FIG. 5, the correlation between them has a characteristic such that the current value decreases as the in-cylinder pressure increases, for example, a linear correlation. Additionally, the correlation between them is hardly affected irrespective of a change in engine revolution speed, a change in the intensity of gas flow, and the like. Therefore, it is possible to univocally estimate the in-cylinder pressure at ignition timing based on the current value Idis of the secondary current immediately after completion of capacitive discharge.

The in-cylinder pressure at ignition timing, estimated as discussed above, can be utilized for various controls. For instance, the estimated in-cylinder pressure at ignition timing can be applied to detection of a time-dependent change in mechanical compression ratio over time, caused by accumulation of deposits or detection of a variation in compression ratio of each individual cylinder.

Figure 6:
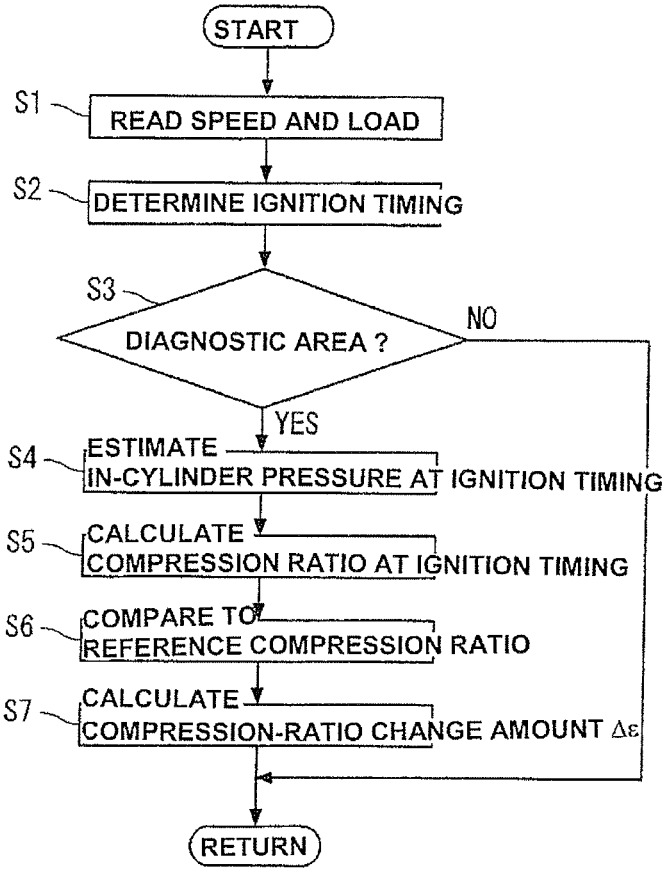
FIG. 6 is a flowchart illustrating a first embodiment of the invention.

Referring to FIG. 6, there is shown the flowchart illustrating the flow of concrete processing of the first embodiment in which in-cylinder pressure estimation is utilized for estimation of a time-dependent change in mechanical compression ratio. The processing shown in this flowchart is executed within the engine controller 10 each time each cylinder is ignited.

At step S1, engine revolution speed and load of internal combustion engine 1 are read, and then at step S2 ignition timing is determined.

Figure 7:
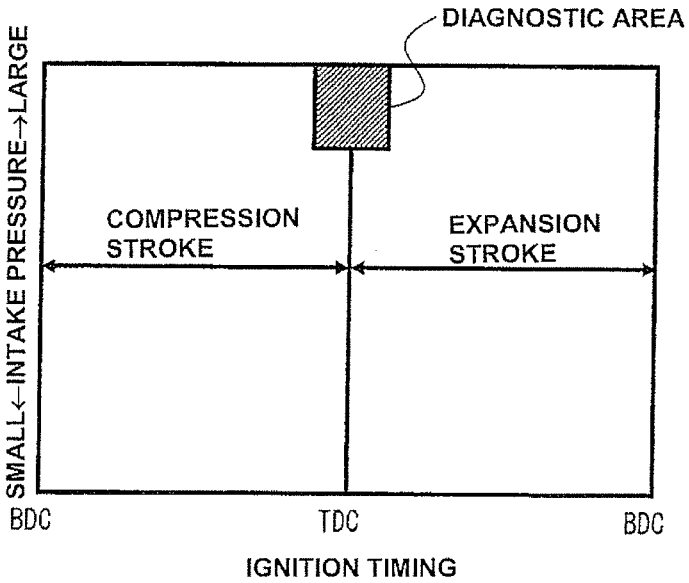
FIG. 7 is an explanatory view illustrating a diagnostic area.

At step S3, a check is made to determine whether an operating condition suited to carry out a diagnosis on a time-dependent change in mechanical compression ratio is satisfied. FIG. 7 is the explanatory view illustrating a diagnostic area. In the explanatory view, as an operating condition of internal combustion engine 1, the axis of abscissa is taken as "ignition timing", while the axis of ordinate is taken as "intake pressure". As appreciated from the explanatory view, a diagnosis on a time-dependent change in compression ratio is carried out within a specified diagnostic area in which the intake pressure is high and ignition timing is set near the top dead center (TDC) position. The diagnostic area corresponds to approximately a low-speed full-load range of internal combustion engine 1. By the way, execution of the diagnosis is not limited to a steady operation. The diagnosis may be carried out under another operating condition in which ignition timing has controlled and retarded to the vicinity of the TDC position (i.e., within the diagnostic area) due to a certain factor.

Figure 8:
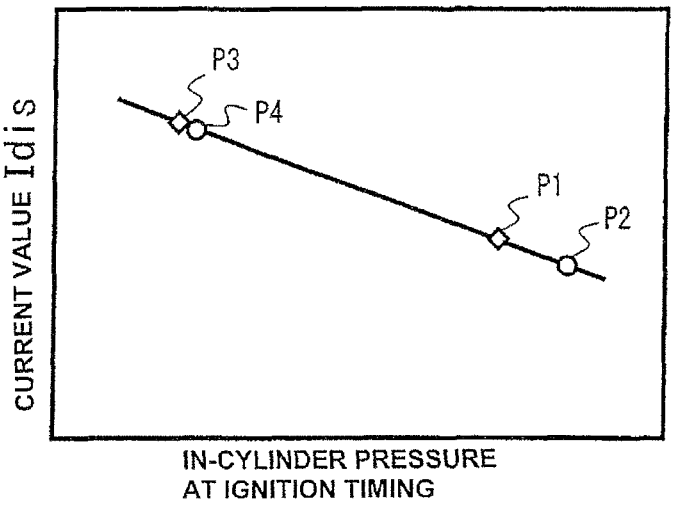
FIG. 8 is an explanatory view illustrating the magnitude of a change in the current value when a compression ratio changes with lapse of time.

The reason for setting of the diagnostic area as discussed above can best be explained by considering that a change in in-cylinder pressure, caused by a time-dependent change in compression ratio, remarkably appears or increases, as the in-cylinder pressure at ignition timing increases. FIG. 8 is the explanatory view illustrating the relationship between them. For instance, suppose that, at the initial phase of an operating condition in which an in-cylinder pressure at ignition timing is comparatively high, the in-cylinder pressure is a pressure value denoted by a point "P1", and then a given time-dependent change in mechanical compression ratio occurs. As a result of this, the in-cylinder pressure shifts to a pressure value denoted by a point "P2". Between the point "P1" and the point "P2", a change in in-cylinder pressure, consequently a change in current value Idis becomes produced comparatively large. In contrast to the above, suppose that, at the initial phase of an operating condition in which an in-cylinder pressure at ignition timing is comparatively low, the in-cylinder pressure is a pressure value denoted by a point "P3", and then the same given time-dependent change in mechanical compression ratio occurs. As a result of this, the in-cylinder pressure shifts to a pressure value denoted by a point "P4". Between the point "P3" and the point "P4", a change in in-cylinder pressure, consequently a change in current value Idis becomes comparatively small. In this manner, within a region in which the in-cylinder pressure at ignition timing is higher, a change in in-cylinder pressure with respect to a time-dependent change in mechanical compression ratio, consequently a change in current value Idis with respect to a time-dependent change in mechanical compression ratio becomes produced comparatively larger, and thus the diagnostic accuracy also becomes higher. Hence, in the embodiment of FIG. 6, the diagnosis is carried out only within the specified diagnostic area shown in FIG. 7.

When step S3 determines that the current operating condition is within the diagnostic area, the routine proceeds to step S4. At step S4, an in-cylinder pressure Pign at ignition timing is estimated based on the current value Idis according to the characteristic of FIG. 5. For instance, a corresponding value to be estimated is retrieved from a table created according to the characteristic of FIG. 5.

Then, at step S5, a compression ratio εign (a mechanical compression ratio) at ignition timing is calculated based on the in-cylinder pressure Pign at ignition timing.

In-cylinder pressure Pign at ignition timing has a specified relationship with an intake pressure P1, a compression ratio εign at ignition timing, and a ratio of specific heat κ, as defined by the following expression (1).

$$Pign = P1 \times \varepsilon ign^{\kappa} \quad (1)$$

Therefore, the compression ratio εign at ignition timing is derived from the following expression (2).

$$\varepsilon ign = \exp\{\ln(Pign)/P1\}/\kappa \quad (2)$$

Hereupon, the intake pressure P1 and the ratio of specific heat κ can be obtained by reference to a pre-prepared map or table created based on engine revolution speed and load, or ignition timing, which informational signals are taken as parameters. By the way, intake pressure P1 may be detected directly by means of an intake pressure sensor, which is installed in the intake collector 8.

At step S6, the estimated compression ratio εign at ignition timing is compared to an original reference compression ratio (a reference mechanical compression ratio at the same ignition timing). The reference compression ratio is retrieved from the pre-prepared table created based on ignition timing taken as a parameter.

In lieu thereof, a piston position may be determined or derived from ignition timing, and then a reference compression ratio corresponding to each ignition timing may be calculated based on the determined piston position.

At step S6, an amount of time-dependent change in compression ratio at ignition timing can be determined or derived from the comparison results. Hence, via step S7, the amount of time-dependent change in compression ratio at ignition timing is finally converted into an amount of change Δε in mechanical compression ratio ε at the piston top dead center (TDC) position, generally denoted as "mechanical compression ratio".

By the previously-discussed processing, an amount of time-dependent change Δε in compression ratio of a certain cylinder can be calculated. By sequentially performing this processing, the time-dependent change in compression ratio of each of cylinders can be calculated.

The second embodiment of the invention is hereunder explained. In the second embodiment, an in-cylinder pressure at ignition timing is estimated based on both an engine revolution speed and a discharge duration during which a secondary current flows. That is, as shown in FIG. 4B, engine controller 10 reads a time duration, during which a secondary current above a predetermined threshold value flows, as a discharge duration Tdis. The previously-noted threshold value is set to an appropriate value suited to avoid erroneous detection. For instance, the threshold value may be set to a predetermined minimum value substantially equivalent to a zero current value.

Figure 9:
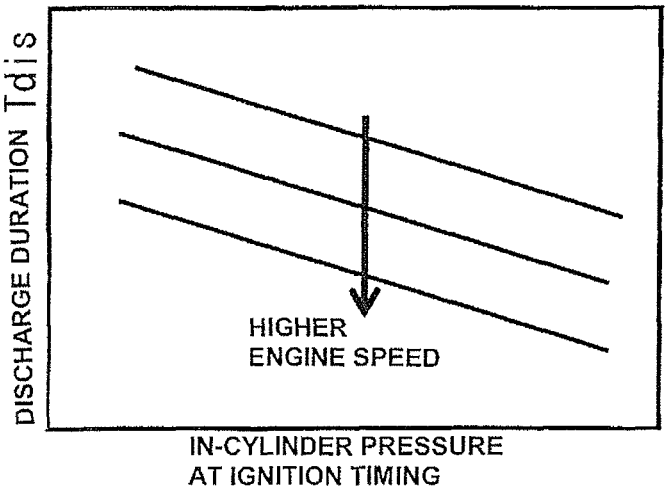
FIG. 9 is a characteristic diagram illustrating the relationship between the discharge duration and the in-cylinder pressure at ignition timing.

According to a new knowledge of the inventor, the detected discharge duration Tdis, which is explained by reference to FIG. 4B, is correlated with an in-cylinder pressure at ignition timing (i.e., a gas pressure between the electrodes). As shown in FIG. 9, the correlation between them has a characteristic such that the discharge duration shortens as the in-cylinder pressure increases, for example, a linear correlation. Additionally, the discharge duration shortens, as the engine revolution speed increases. Except for a change in engine revolution speed, the correlation between them is hardly affected irrespective of a change in the intensity of gas flow. Therefore, it is possible to univocally estimate the in-cylinder pressure at ignition timing based on both the discharge duration Tdis and engine revolution speed.

Figure 10:
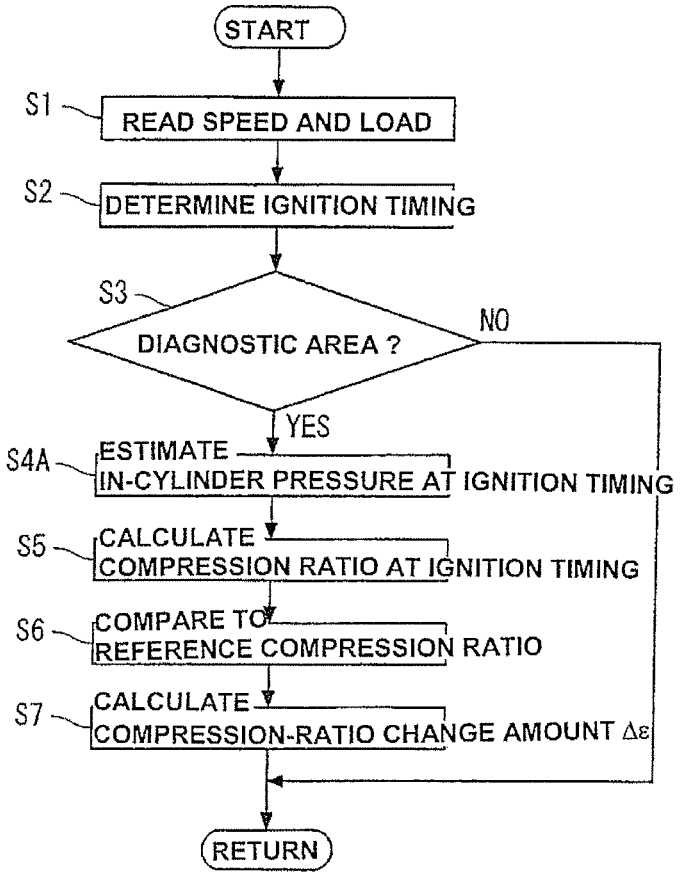
FIG. 10 is a flowchart illustrating a second embodiment of the invention.

Referring to FIG. 10, there is shown the flowchart illustrating the flow of concrete processing of the second embodiment in which in-cylinder pressure estimation is utilized for estimation of a time-dependent change in mechanical compression ratio. The processing shown in this flowchart is executed within the engine controller 10 each time each cylinder is ignited.

By the way, the same step numbers S1-S3, and S5-S7 used to designate steps in the flowchart of FIG. 6 will be applied to the corresponding step numbers used in the second embodiment. Thus, at step S1, engine revolution speed and load of internal combustion engine 1 are read, and then at step S2 ignition timing is determined. At step S3, a check is made to determine whether an operating condition suited to carry out a diagnosis on a time-dependent change in mechanical compression ratio is satisfied. When the current operating condition is out of the diagnostic area shown in FIG. 7, one cycle of the routine terminates. In contrast, when the current operating condition is within the diagnostic area, the routine proceeds to step S4A.

At step S4A, an in-cylinder pressure Pign at ignition timing is estimated based on the discharge duration Tdis and engine revolution speed according to the characteristic of FIG. 9. For instance, a corresponding value to be estimated is retrieved from a three-dimensional map created according to the characteristic of FIG. 9.

Then, at step S5, as discussed previously, a compression ratio εign at ignition timing is calculated based on the in-cylinder pressure Pign at ignition timing. Thereafter, at step S6, the estimated compression ratio sign at ignition timing is compared to an original reference compression ratio (a reference mechanical compression ratio at the same ignition timing). Finally, at step S7, an amount of change Δε in mechanical compression ratio ε at the piston TDC position is calculated.

By the previously-discussed processing of the second embodiment, in a similar manner to the first embodiment, an amount of time-dependent change Δε in compression ratio of a certain cylinder can be calculated. By sequentially performing this processing, the time-dependent change in compression ratio of each of cylinders can be calculated.

Figure 11:
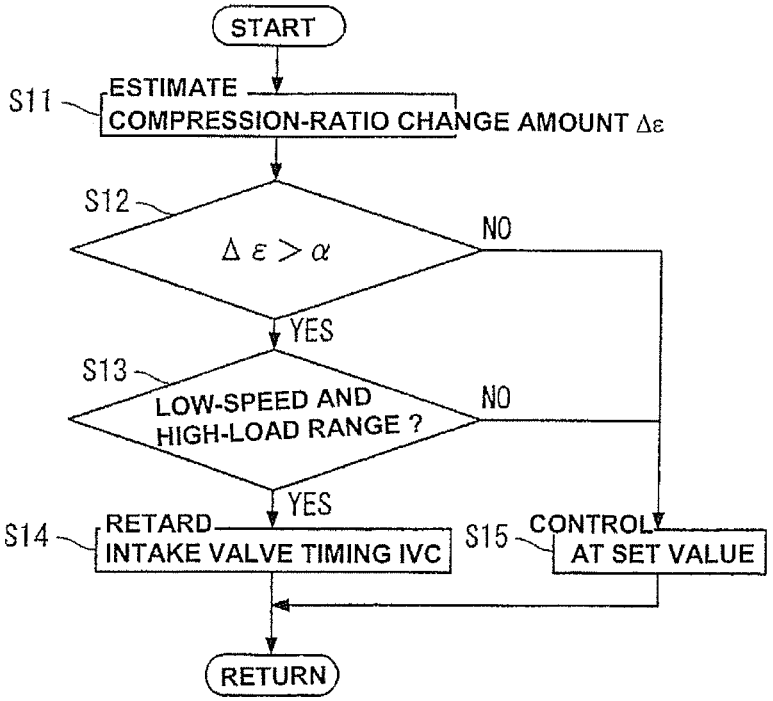
FIG. 11 is a flowchart illustrating one example of processing in which a correction to an effective compression ratio is made responsively to a change in compression ratio.

Referring to FIG. 11, there is shown the flowchart illustrating one example of processing executed responsively to the time-dependent change in compression ratio obtained by the system of the first embodiment or the second embodiment. The example of FIG. 11 shows the processing in which when a time-dependent change in mechanical compression ratio (concretely, an increase in mechanical compression ratio) has occurred due to accumulation of deposits, an effective compression ratio is reduced to less than a normal set value via the variable valve actuation device 6 in order to suppress pre-ignition or knocking.

At step S11, according to the previously-discussed processing method of the first embodiment or the second embodiment, an amount of time-dependent change Δε in mechanical compression ratio (simply, an amount of time-dependent change in compression ratio) is calculated. At step S12, a check is made to determine whether the amount of time-dependent change Δε in compression ratio is greater than a threshold value α. When the compression-ratio change amount Δε is greater than the threshold value α, the routine proceeds to step S13 where it determines whether or not the current operating condition is within a predetermined low-speed high-load range in which abnormal combustion, such as pre-ignition or knocking, tends to occur. When the answer to this step S13 is in the affirmative (YES), the routine proceeds to step S14 where intake valve closure timing (IVC) timed after the bottom dead center (BDC) position is retarded and corrected via the variable valve actuation device 6, with the result that the effective compression ratio is reduced to less than a normal set value. In contrast, when the answer to step S12 is in the negative (NO) or when the answer to step S13 is in the negative (NO), the routine proceeds to step S15 where intake valve closure timing is controlled as usual.

By the way, for instance, in the case that the variable valve actuation device 6 is configured to individually vary intake valve closure timings for each individual cylinder, intake valve closure timings can be individually retarded and corrected for each individual cylinder responsively to the compression-ratio change amount Δε of each of the cylinders. In lieu thereof, in the case that the valve actuation system is configured to simultaneously vary intake valve closure timings of all of cylinders, a mean value of compression-ratio change amounts Δε of all of cylinders or a maximum value of compression-ratio change amounts Δε of the individual cylinders may be compared to a permissible value (i.e., threshold value α) at step S12 for instance.

Figure 12:
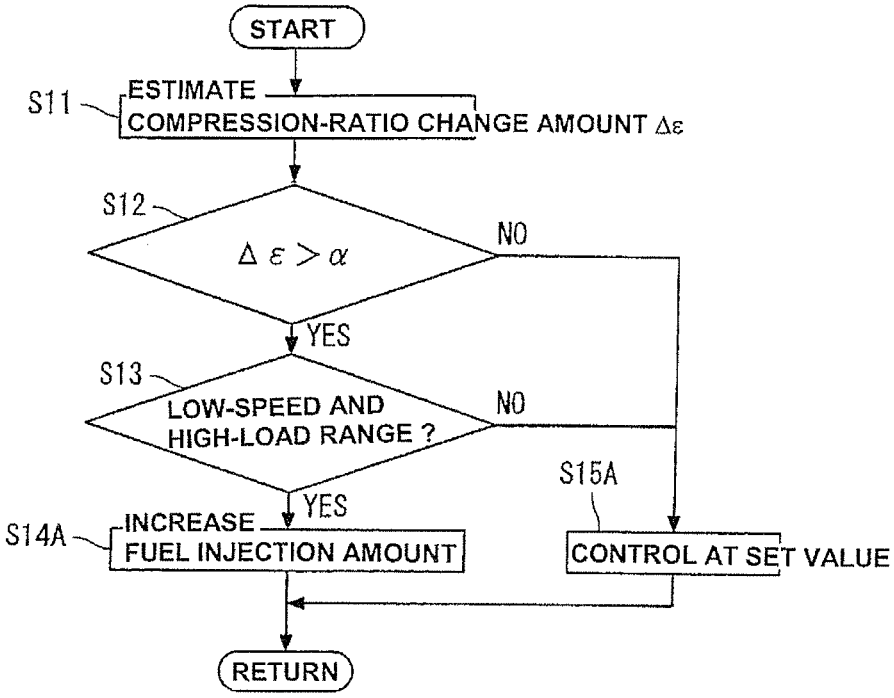
FIG. 12 is a flowchart illustrating another example of processing in which a correction to a fuel injection amount is made responsively to a change in compression ratio.

Referring to FIG. 12, there is shown the flowchart illustrating another example of processing executed responsively to the time-dependent change in compression ratio obtained by the system of the first embodiment or the second embodiment. The example of FIG. 12 shows the processing in which when a time-dependent change in mechanical compression ratio (concretely, an increase in mechanical compression ratio) has occurred due to accumulation of deposits, a fuel injection amount of an associated cylinder is increased in order to suppress pre-ignition or knocking.

The same step numbers S11-S13 used to designate steps in the processing of FIG. 11 will be applied to the corresponding step numbers used in the processing of FIG. 12. At step S11, according to the previously-discussed processing method of the first embodiment or the second embodiment, an amount of time-dependent change $\Delta\varepsilon$ in mechanical compression ratio is calculated. At step S12, a check is made to determine whether the amount of time-dependent change $\Delta\varepsilon$ in compression ratio is greater than a threshold value $\alpha$ (that is, a permissible value). When the compression-ratio change amount $\Delta\varepsilon$ is greater than the threshold value $\alpha$, the routine proceeds to step S13 where it determines whether or not the current operating condition is within a predetermined low-speed high-load range in which abnormal combustion, such as pre-ignition or knocking, tends to occur. When the answer to this step S13 is in the affirmative (YES), the routine proceeds to step S14A where a fuel injection amount injected from the fuel injection valve 2 is incrementally corrected. In contrast, when the answer to step S12 is in the negative (NO) or when the answer to step S13 is in the negative (NO), the routine proceeds to step S15A where the fuel injection amount is controlled as usual.

By the way, the previously-discussed incremental correction to a fuel injection amount for the purpose of suppressing knocking and the like may be made to only the cylinder whose compression-ratio change amount $\Delta\varepsilon$ exceeds the threshold value $\alpha$. In lieu thereof, the previously-discussed incremental correction to a fuel injection amount for the purpose of suppressing knocking and the like may be made to all of cylinders simultaneously.

In addition to the previously-discussed correction processing for a time-dependent change in compression ratio, for instance when the compression-ratio change amount $\Delta\varepsilon$ exceeds the permissible value, for the purpose of burning and removing deposits accumulated in the cylinders, deposit combustion operation may be executed to positively raise the combustion temperature.

By the way, in the shown embodiment, detection (estimation) of in-cylinder pressure at ignition timing is utilized for or applied to detection (estimation) of a time-dependent change in mechanical compression ratio. Furthermore, it is possible to detect a variation (a dispersion) in compression ratio between cylinders in a multi-cylinder internal combustion engine, utilizing detection of in-cylinder pressure at ignition timing. That is, it is possible to easily detect a variation (a dispersion) in compression ratio between cylinders by individually detecting an in-cylinder pressure at ignition timing of each individual cylinder during operation of the internal combustion engine. Thus, a correction to a fuel injection amount and fuel injection timing for each of the cylinders and a correction to ignition timing for each of the cylinders can be made, while taking account of the previously-noted dispersion in compression ratio.

What is claimed is:

1. An ignition device for an internal combustion engine in which a discharge voltage is generated between electrodes of a spark plug connected to a secondary coil by energizing a primary current to a primary coil of an ignition coil and interrupting the primary current, comprising:

a controller configured to:

monitor a secondary current flowing across the electrodes of the spark plug;

estimate an in-cylinder pressure at ignition timing based on both i) an engine revolution speed and ii) a discharge duration during which the secondary current flows, wherein the discharge duration shortens as the in-cylinder pressure increases, and wherein the discharge duration shortens as the engine revolution speed increases;

detect an amount of time-dependent change in mechanical compression ratio based on the estimated in-cylinder pressure; and determine whether the amount of time-dependent change in mechanical compression ratio exceeds a threshold value, wherein, when the amount of time-dependent change in mechanical compression ratio exceeds the threshold value, intake valve closure timing timed after a bottom dead center position is retarded and corrected, and wherein the retarded and corrected intake valve closure timing reduces an effective compression ratio to less than a normal set value.

2. An ignition device for an internal combustion engine in which a discharge voltage is generated between electrodes of a spark plug connected to a secondary coil by energizing a primary current to a primary coil of an ignition coil and interrupting the primary current, comprising:

a controller configured to:

monitor a secondary current flowing across the electrodes of the spark plug;

estimate an in-cylinder pressure at ignition timing based on both i) an engine revolution speed and ii) a discharge duration during which the secondary current flows, wherein the discharge duration shortens as the in-cylinder pressure increases, and wherein the discharge duration shortens as the engine revolution speed increases;

detect an amount of time-dependent change in mechanical compression ratio based on the estimated in-cylinder pressure; and determine whether the amount of time-dependent change in mechanical compression ratio exceeds a threshold value, wherein, when the amount of time-dependent change in mechanical compression ratio exceeds the threshold value, a fuel injection amount of an associated cylinder is incrementally corrected.

3. An ignition device for an internal combustion engine in which a discharge voltage is generated between electrodes of a spark plug connected to a secondary coil by energizing a primary current to a primary coil of an ignition coil and interrupting the primary current, comprising:

a controller configured to:

monitor a secondary current flowing across the electrodes of the spark plug;

estimate an in-cylinder pressure at ignition timing based on both i) an engine revolution speed and ii) a discharge duration during which the secondary current flows, wherein the discharge duration shortens as the in-cylinder pressure increases, and wherein the discharge duration shortens as the engine revolution speed increases;

detect an amount of time-dependent change in mechanical compression ratio based on the estimated in-cylinder pressure; and determine whether the amount of time-dependent change in mechanical compression ratio exceeds a threshold value, wherein, when the amount of time-dependent change in mechanical compression ratio exceeds the threshold value, deposit combustion operation is executed to positively raise combustion temperature for burning and removing deposits accumulated in cylinders.

4. An ignition device for an internal combustion engine in which a discharge voltage is generated between electrodes of a spark plug by energizing a primary current to a primary coil of an ignition coil and interrupting the primary current, wherein the spark plug is connected to a secondary coil of the ignition coil, the ignition device comprising: a controller configured to: monitor a secondary current flowing across the electrodes of the spark plug; determine a time instant at which an event of capacitive discharge of the spark plug is completed; determine a parameter of the secondary current derived from behavior of the secondary current acquired at the determined time instant; estimate an in-cylinder pressure at ignition timing based on the parameter of the secondary current; and operate the internal combustion engine based on the estimated in-cylinder pressure, wherein the parameter of the secondary current is a current value of the secondary current acquired at the determined time instant.

5. The ignition device as recited in claim 4, wherein the determination of the time instant is implemented by setting the determined time instant to a time instant at which a predetermined time has elapsed from the ignition timing.

6. The ignition device as recited in claim 5, wherein the controller is further configured to:

detect an amount of time-dependent change in mechanical compression ratio based on the estimated in-cylinder pressure; and determine whether the amount of time-dependent change in mechanical compression ratio exceeds a threshold value.

7. The ignition device as recited in claim 6, wherein the controller is further configured to:

calculate the mechanical compression ratio at the ignition timing of an associated cylinder based on the estimated in-cylinder pressure.

8. The ignition device as recited in claim 7, wherein the controller is further configured to:

compare the calculated mechanical compression ratio with a reference mechanical compression ratio corresponding to the ignition timing, wherein the amount of time-dependent change in mechanical compression ratio is calculated based on the comparison of the calculated mechanical compression ratio with the reference mechanical compression ratio corresponding to the ignition timing.

9. The ignition device as recited in claim 6, wherein the in-cylinder pressure is estimated for each individual cylinder in a multi-cylinder internal combustion engine, for determining a dispersion in in-cylinder pressure of each of the cylinders.

10. The ignition device as recited in claim 6, wherein the in-cylinder pressure is estimated under a specified operating condition of the internal combustion engine where an intake pressure is high and the ignition timing is set near a top dead center position.

11. The ignition device as recited in claim 6, wherein, when the amount of time-dependent change in mechanical compression ratio exceeds the threshold value, an abnormal combustion condition is determined to occur.

12. An ignition device for an internal combustion engine in which a discharge voltage is generated between electrodes of a spark plug by energizing a primary current to a primary coil of an ignition coil and interrupting the primary current, wherein the spark plug is connected to a secondary coil of the ignition coil, the ignition device comprising: a controller configured to: monitor a secondary current flowing across the electrodes of the spark plug; determine a time instant at which an event of capacitive discharge of the spark plug is completed; determine a parameter of the secondary current derived from behavior of the secondary current acquired at or after the determined time instant; estimate an in-cylinder pressure at ignition timing based on the parameter of the secondary current; and operate the internal combustion engine based on the estimated in-cylinder pressure, wherein the parameter of the secondary current is a discharge duration of the spark plug during which the secondary current flows; and wherein the controller is further configured to implement the estimation of the in-cylinder pressure by estimating the in-cylinder pressure based on the parameter of the secondary current and based on an engine revolution speed of the internal combustion engine.

13. The ignition device as recited in claim 12, wherein the estimation of the in-cylinder pressure is implemented under a condition that the discharge duration shortens as the in-cylinder pressure increases, and wherein the discharge duration shortens as the engine revolution speed increases.

14. The ignition device as recited in claim 12, wherein the controller is further configured to:

detect an amount of time-dependent change in mechanical compression ratio based on the estimated in-cylinder pressure; and determine whether the amount of time-dependent change in mechanical compression ratio exceeds a threshold value.

15. The ignition device as recited in claim 14, wherein a time duration during which the secondary current above a predetermined threshold value flows is detected as the discharge duration.

16. The ignition device as recited in claim 14, wherein the controller is further configured to:

calculate the mechanical compression ratio at the ignition timing of an associated cylinder based on the estimated in-cylinder pressure.

17. The ignition device as recited in claim 16, wherein the controller is further configured to:

compare the calculated mechanical compression ratio with a reference mechanical compression ratio corresponding to the ignition timing, wherein the amount of time-dependent change in mechanical compression ratio is calculated based on the comparison of the calculated mechanical compression ratio with the reference mechanical compression ratio corresponding to the ignition timing.

18. The ignition device as recited in claim 14, wherein the in-cylinder pressure is estimated for each individual cylinder in a multi-cylinder internal combustion engine, for determining a dispersion in in-cylinder pressure of each of the cylinders.

19. The ignition device as recited in claim 14, wherein the in-cylinder pressure is estimated under a specified operating condition of the internal combustion engine where an intake pressure is high and the ignition timing is set near a top dead center position.

20. The ignition device as recited in claim 14, wherein, when the amount of time-dependent change in mechanical compression ratio exceeds the threshold value, an abnormal combustion condition is determined to occur.

21. An ignition method for an internal combustion engine in which a discharge voltage is generated between electrodes of a spark plug by energizing a primary current to a primary coil of an ignition coil and interrupting the primary current, wherein the spark plug is connected to a secondary coil of the ignition coil, the ignition method comprising: monitoring a secondary current flowing across the electrodes of the spark plug; determining a time instant at which an event of capacitive discharge of the spark plug is completed; determining a parameter of the secondary current derived from behavior of the secondary current acquired at the determined time instant; estimating an in-cylinder pressure at ignition timing based on the parameter of the secondary current; and operating the internal combustion engine based on the estimated in-cylinder pressure, wherein the parameter of the secondary current is a current value of the secondary current acquired at the determined time instant.

22. The ignition method as recited in claim 21, wherein the determination of the time instant is implemented by setting the determined time instant to a time instant at which a predetermined time has elapsed from the ignition timing.

23. An ignition method for an internal combustion engine in which a discharge voltage is generated between electrodes of a spark plug by energizing a primary current to a primary coil of an ignition coil and interrupting the primary current, wherein the spark plug is connected to a secondary coil of the ignition coil, the ignition method comprising: monitoring a secondary current flowing across the electrodes of the spark plug; determining a time instant at which an event of capacitive discharge of the spark plug is completed; determining a parameter of the secondary current derived from behavior of the secondary current acquired at or after the determined time instant; estimating an in-cylinder pressure at ignition timing based on the parameter of the secondary current; and operating the internal combustion engine based on the estimated in-cylinder pressure, wherein the parameter of the secondary current is a discharge duration of the spark plug during which the secondary current flows; and wherein the estimation of the in-cylinder pressure is implemented by estimating the in-cylinder pressure based on the parameter of the secondary current and based on an engine revolution speed of the internal combustion engine.

* * * * *